US006773283B2

(12) United States Patent
Yoshimatsu et al.

(10) Patent No.: US 6,773,283 B2
(45) Date of Patent: Aug. 10, 2004

(54) SWITCHABLE CONNECTOR DEVICE

(75) Inventors: Kazuharu Yoshimatsu, Aichi (JP); Yoshiaki Kato, Aichi (JP); Keiichi Ito, Aichi (JP); Kazuyuki Shiraki, Aichi (JP); Masanori Wakui, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/858,906

(22) Filed: May 17, 2001

(65) Prior Publication Data

US 2002/0013079 A1 Jan. 31, 2002

(30) Foreign Application Priority Data

May 19, 2000 (JP) ..... P. 2000-148110

(51) Int. Cl.[7] ..... H01R 13/62

(52) U.S. Cl. ..... 439/180; 439/188; 439/247; 200/51.09; 200/51.05

(58) Field of Search ..... 200/51.05, 51.06, 200/51 R, 51.09, 51.12; 439/180, 188, 247, 52, 53, 171–174, 259, 260, 262, 270

(56) References Cited

U.S. PATENT DOCUMENTS 3,599,167 A * 8/1971 Adrian et al. ..... 439/186
4,075,444 A * 2/1978 Hollingsead et al. .... 200/51.09
4,136,918 A * 1/1979 Claesson et al. ..... 439/172

FOREIGN PATENT DOCUMENTS

GB 2 044 556 A * 10/1980

* cited by examiner

*Primary Examiner*—Tho D. Ta
(74) *Attorney, Agent, or Firm*—Morgan, Lewis & Bockius LLP

(57) ABSTRACT

A connector housing (6) of the connector device (1) is composed of an outer housing (9) to be mounted onto a printed circuit board (2) by screwing, and an inner housing (8) connected to the outer housing (9) so as to be movable in the right and left direction with respect to the outer housing (9). Into the inner housing (8), there is incorporated a terminal (7) including a connecting portion (7*a*) to be connected by a terminal (5) of a mating connector device (3), a spring portion (7*c*), and a switch contact (7*b*) respectively formed integral with the terminal (7). On the printed circuit board (2), there is disposed an electrode (2*a*) with which the switch contact (7*b*) can be elastically contacted. Thanks to this structure, by switchingly moving the inner housing (8) in the right and left direction, circuit switching can be achieved.

3 Claims, 3 Drawing Sheets

SWITCHABLE CONNECTOR DEVICE

BACKGROUND OF THE INVENTION

1. Field of the Invention

The present invention relates to a connector device in which a terminal is incorporated in a connector housing thereof.

2. Related Art

For example, when connecting a printed circuit board to an external circuit, a female connector device is mounted on the printed circuit board and is connected to its mating (male) connector device connected to the external circuit side to thereby connect the printed circuit board to the external circuit. In this case, generally, the connector device is structured such that, in case where the base end portion of the terminal thereof is inserted into and soldered to the through hole of the printed circuit board, the connector device can be mounted fixedly to the printed circuit board. Also, when it is necessary to switch the electrical connection state of the external circuit, that is, it is necessary to connect and disconnect the external circuit through the connector device, another switch device is disposed on the printed circuit board.

However, in case where the connector device and switch device are disposed separately on the printed circuit board, the number of parts increases and the installation space of the printed circuit board increases.

SUMMARY OF THE INVENTION

In view of this, the present inventors et al. have tried to add a circuit switching function to the connector device. In this case, however, in case where incorporation of the circuit switching function into the connector device increases the size of the connector device excessively and complicates the structure of the connector device greatly, such circuit switching function incorporation conflicts with the expected object thereof.

The present invention aims at eliminating the above defects. Accordingly, it is an object of the invention to provide a connector device which not only can integrally incorporate a circuit switching function therein but also can have a simple structure.

In attaining the above object, according to a first aspect of the invention, there is provided a connector device including:

a connector housing; and a terminal incorporated into the connector housing, the terminal including, a connecting portion on a leading end side of the terminal, which is connected to a mating terminal of a mating connector device when the mating connector device is connected to the connector housing, and a switch contact formed integral with the terminal on the base end side of the terminal.

According to first aspect of the present connector device, the terminal has not only its normal connecting function to be performed by a connecting portion thereof connectable with the terminal of the mating connector device but also a circuit switching function to be performed by a switch contact formed integral with the terminal. According to this, not only circuit switching using the switch contact is possible but also there is eliminated the need to provide a switch contact separately from the terminal, which allows the present connector device to have a simple structure.

According to a second aspect of the invention, in the connector device of the first aspect, the terminal includes a spring portion formed integral therewith and interposed between the connector portion and the switch contact to apply an elastic contact force to the switch contact. According to the second aspect of the invention, there is eliminated the need for separate provision of a spring which is used to apply an elastic contact force to the switch contact, thereby being able to simplify the structure of the connector device further.

According to a third aspect of the invention, in the connector device of the first aspect of the invention, the connector device is adapted to be mounted on a printed circuit board including an electrode disposed thereon and used together therewith, the connector housing includes an inner housing supporting the terminal, and an outer housing fixed to the printed circuit board and supporting the inner housing, so that the inner hosing housing is movable with respect to the outer housing as a switching movement, the switch contact is shifted to switch a contact state with respect to the electrode by the switching movement.

According to the third aspect of the invention, by switchingly moving the inner housing with respect to the outer housing, the switch contact of the terminal can be shifted so that the contact state of the switch contact with respect to the electrode on the printed circuit board can be switched. Therefore, the inner housing, to which the mating connector device is to be connected, can be used in such a manner that it can perform not only the function of the switch operation portion but also the circuit switching function.

According to a fourth aspect of the invention, in the connector device of the third aspect, the inner housing includes a securing pawl portion which is integrally formed therewith and elastically secures the inner housing to the outer housing to allow the switching movement.

DETAILED DESCRIPTION OF THE PREFERRED EMBODIMENTS

Figure 1A:
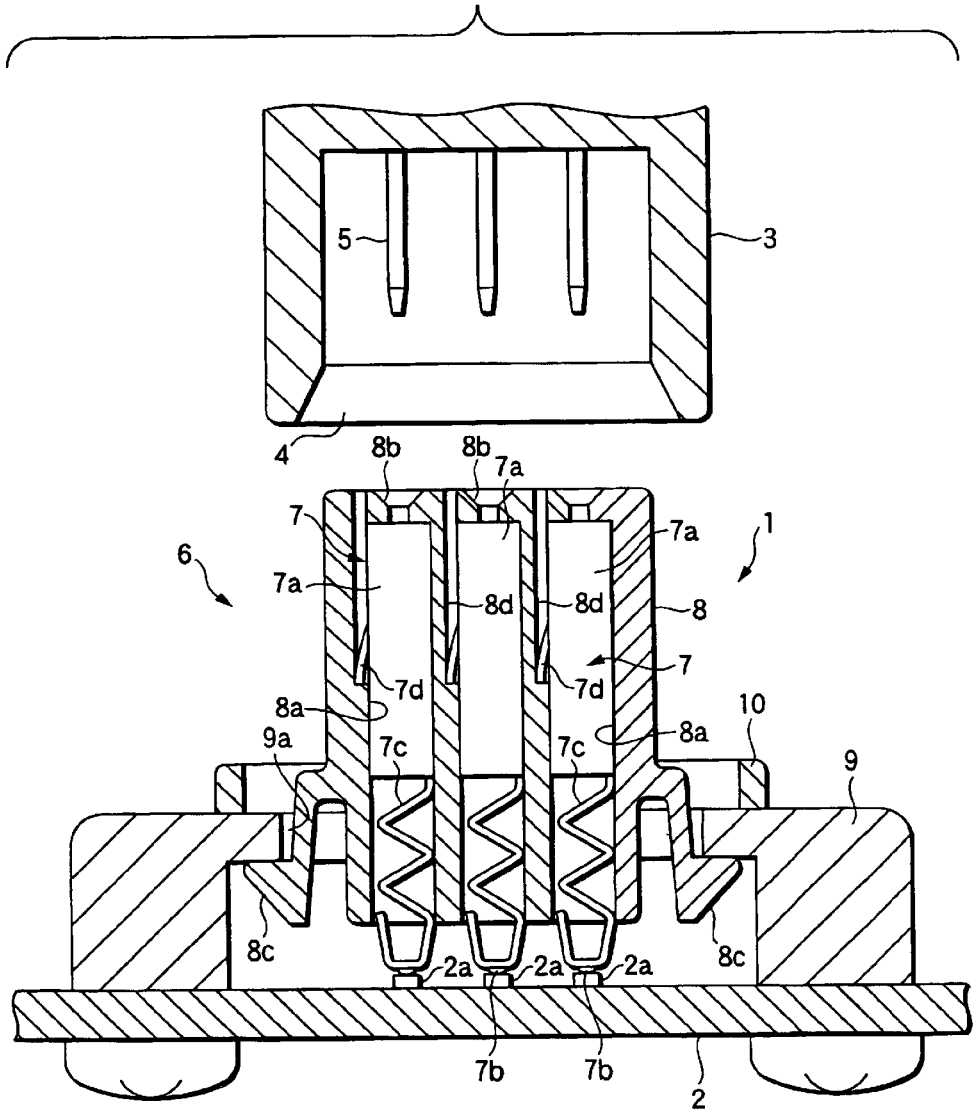
FIG. 1A is a longitudinal front section view of an embodiment of a connector device according to the invention, showing the structures of the connector device and its mating connector device before they are connected together.

Now, description will be given below of an embodiment of a connector device according to the invention with reference to the accompanying drawings FIG. 1A a longitudinal section view of a connector device 1 according to the present embodiment, showing a state thereof in which it is mounted on a printed circuit board 2 with a given circuit formed therein; and, FIG. 1A also shows the leading end portion (fitting portion) of a mating connector device 3 which is to be paired with the connector device 1.

By the way, in the present embodiment, the connector device is structured as a female connector, while the mating connector device 3 is structured as a male connector. Referring to the structure of the leading end portion of the mating connector device 3, a plurality of (in FIG. 1A, three) pin-shaped terminals are included in the interior portion of a rectangular-shaped fitting recessed portion 4. Also, although not shown, the mating connector device 3 can be connected to an external circuit through a cable.

The connector device 1 according to the present embodiment is structured such that a plurality of (in FIG. 1A, three) female terminals 7 are incorporated into a connector housing 6 formed of insulating material (synthetic resin). In this case, the connector housing 6 comprises an inner housing 8, by which the terminals 7 can be supported, and an outer housing 9 which can be mounted on the printed circuit board 2 and can hold the inner housing 8.

The outer housing 9 is formed in a thin rectangular-box-like shape opened in the lower surface thereof. A rectangular opening 9*a* into which the inner housing 8 can be inserted is formed in the upper wall portion of the outer housing 9. Also, the outer housing 9 can be fixedly mounted on the printed circuit board 2, for example, by screwing it from the lower surface side thereof in such a manner that its peripheral wall portion is placed on the printed circuit board 2.

On the other hand, the inner housing 8 is structured as follows. The leading end side (in FIG. 1A the upper side) thereof is formed in a rectangular-shaped block having such a size as to allow itself to be fitted into the fitting recessed portion 4 of the mating connector device 3. In the interior portion of the leading end side thereof, a plurality of storage portions 8*a* into which their associated terminals 7 can be stored are formed in such a manner that they respectively penetrate through the leading end side interior portion of the inner housing 8 in the vertical direction thereof. Insertion openings 8*b* each having a small diameter in correspondence to the terminals 5 of the mating connector device 3 is formed in the upper end portions of the respective storage portions 8*a*. The lower surfaces of the respective storage portions 8*a* are opened.

Securing pawl portions 8*c* integrally with the inner housing 8 are disposed on the lower portions of the right and left (in FIG. 1A) outer wall portions of the inner housing 8, respectively. The securing pawl portions 8*c* can be elastically deformed by a certain amount in the right and left direction (in FIG. 1B), and can be secured to the lower surface sides of the peripheral edge portions of the rectangular-shaped opening 9*a* of the housing 8 when the inner housing 8 is fitted into the rectangular-shaped openings 9*a*. A rectangular-frame-shaped hold plate 10 are mounted on the outer wall portions of the inner housing 8. The hold plates 10 contacts with the upper surface of the outer housing 9 and holds the upper wall portion of the outer housing 9 between the securing pawl portions 8*c* and themselves, thereby being able to restrict the vertical (in FIG. 1A) movement of the inner housing 8.

Thus, in case where the lower portion of the inner housing 8 is fitted into the rectangular-shaped openings 9*a* of the outer housing 9, the connector housing 5 can be formed, and at the then time, the inner housing 8 can be slidably moved (switching movement) in the right and left (in FIG. 1B) direction with respect to the outer housing 9 in such a range where the securing pawl portions 8*c* can be elastically deformed. By the way, in a state where the inner housing 8 is connected to the outer housing 9, the lower end of the inner housing 8 is positioned so as to float up slightly from the upper surface of the printed circuit board 2.

Each of the terminals 7 is made of a metal plate. As shown in FIG. 2 as well, each of the terminals 7 includes a connecting portion 7*a* on the leading end side (in FIG. 2, on the upper end side) thereof and, a switch contact 7*b*, formed integral with the terminal 7, on the base end side (in FIG. 2, on the lower end side) thereof. Further, the portion of the terminal 7, which is present between the connecting portion 7*a* and switch contact 7*b*, is bent alternately in a zigzag manner, so that a spring portion 7*c* is formed integral with the lower portion of the terminal 7. By the way, although not shown in detail in FIGS. 1A and 1B and 2, the connecting portion 7*a* is formed of two opposing plates whose upper portions are respectively downwardly fold to the inside in a curved manner, so that the connecting portion 7*a* holds the present terminal 5 in such a manner that the two opposing plates sandwich the terminal 5 therein when the terminal 5 of the mating connector device 3 is inserted into the connecting portion 7*a* from above.

Figure 1B:
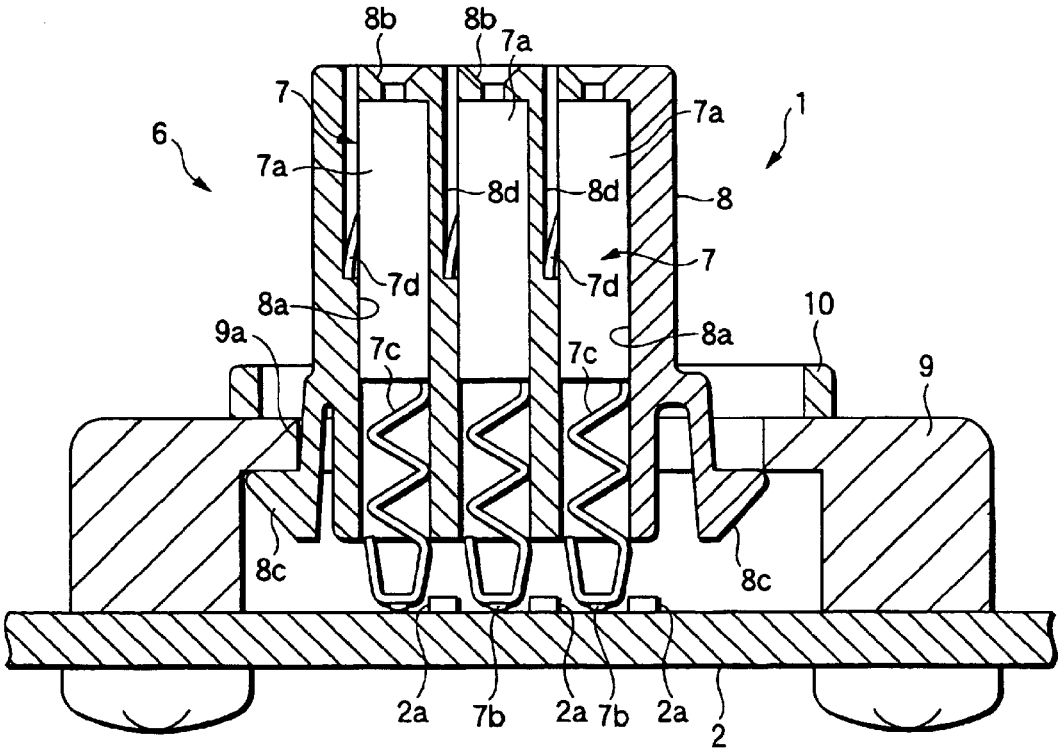
FIG. 1B shows the connector device is slidably moved from the position shown in FIG. 1A.
Figure 2:
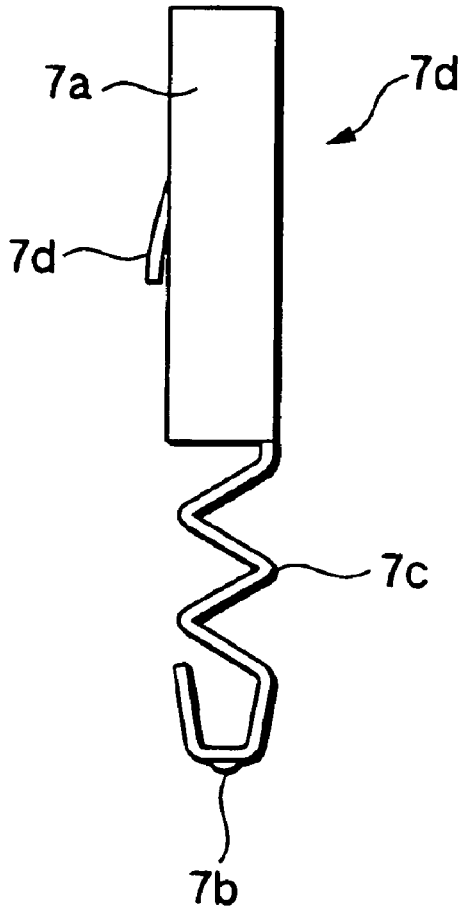
FIG. 2 is a front view of a terminal according to the invention.

As shown in FIG. 1A, the terminals 7 are respectively inserted into their associated storage portions 8*a* of the inner housing 8 from below and mounted therein. In this operation, in case where the terminal 7 is inserted into the extreme end of the storage portion 8*a*, a removal preventive piece portion 7*d* formed integral with the terminal 7 is fitted into a removal preventive groove 8*d* formed in the inner wall of the storage portion 8*a* of the inner housing 8, whereby the terminal 7 can be fixed to the storage portion 8*a* so as to prevent the terminal from removal in the downward direction. And, in such mounted state, the lower end portion of the terminal 7 is positioned so as to project downwardly from the lower end of the inner housing 8.

On the other hand, wiring patterns are disposed on the upper surface portion of the printed circuit board 2. Electrodes 2*a* used as fixed contacts are disposed on the portion of the wiring patterns on which the connector device 1 is to be mounted in correspondence to the switch contacts 7*b* of the associated terminal 7.

According to the above structure, in the present embodiment, in normal state, that is, when an external force is not applied to the inner housing 8, the switch contacts 7*b* of the terminals 7 are respectively contacted with their associated electrodes 2*a*. And, in case where the inner housing 8 is switching moved in the right and left (in FIG. 1B) direction, the switch contacts 7*b* are shifted (slidingly moved) in the lateral direction and are thereby separated from their associated electrodes 2*a*, so that the contact states thereof can be switched. At this time, the spring portion 7*c* applies an elastic contact force to the switch contact 7*b*, which acts on the surface of the printed circuit board 2.

In the above structure, when connecting the printed circuit board 2 to an external circuit electrically, the mating connector device 3 is connected to the connector device 1 mounted on the printed circuit board 2. In this connecting operation, the fitting recessed portion 4 of the mating connector device 3 is fitted with the upper half portion of the inner housing 8 of the connector device 1, the terminal 5 of the mating connector device 3 is contacted with the connecting portion 7*a* of the terminal 7 of the inner housing 8, and the switch contact 7*b* of the terminal 7 is contacted with the electrode 2*a*, thereby being able to connect the printed circuit board 2 to the external circuit electrically.

Thus, in the above-structured connector device 1, the contact state is switched by moving the inner housing 8 with respect to the outer housing 9 so that the switch contact 7*b* of the terminal 7 is shifted with respect to the electrode 2*a* on the printed circuit board 2, so that, the inner housing 8 to which the mating connector device 3 is to be connected is allowed to function not only as switch operating portion but also as a circuit switching portion. Therefore, by slidingly moving the inner housing 8 (mating connector device 3), for example, by manual control in the right and left (in FIG. 1B) direction, switching of the circuit from connection to disconnection and vice versa through the connector devices 1 and 3 can be realized.

As described above, according to the connector device 1 of the present embodiment, due to integral structure of the switch contact 7*b* in the terminal 7, the terminal 7 can be structured such that it has not only the normal function to connect the connector device 1 to the mating connector device 3 to thereby achieve electric connection between them, but also the circuit switching function integrally incorporated therein. Therefore, differently from the related structure in which a connector device and a switch device are disposed separately, there is eliminated the need to provide a switch contact separately from a terminal. According to this, the present connector device 1 not only can be made compact and thus can be installed in a small space, but also can be structured simply at a low cost.

Also, especially, according to the present embodiment, in the terminal 7, there is integrally disposed the spring portion 7*c* so as to be situated between the connecting portion 7*a* and switch contact 7*b*. According to this, there is eliminated the need to separately provide a spring which is used to apply an elastic contact force to the switch contact 7*b*, which makes it possible to simplify the structure of the connector device 1 further.

By the way, in the present embodiment, the connector device 1 is structured as a female-type connector. However, the connector device 1 may also be structured as a male-type connector. In this case, for example, in case where an inner housing supporting a terminal including a connecting portion and a switch contact is disposed such that it can be moved with respect to an outer housing for switching, there can be obtained similar effects to the illustrated embodiment. Also, a connector device according to the invention can be applied not only to a printed circuit board but also to other various uses.

Also, the connecting structure for connecting together the inner and outer housings as well as the switching structure for switching the connection and disconnection between the switch contact and electrode can also be changed and modified variously. Further, there can also be employed a structure that the inner housing can be held at two positions and thus the switch can be switched at two positions, or a structure that the switching movement of the switch contact (inner housing) is not carried out by manual control but it is carried out by other drive source. That is, the invention can be enforced in other various manners while changing or modifying it properly without departing from the subject matter of the invention.

As can be seen clearly from the foregoing description, according to the connector device of the invention, since a terminal to be incorporated into a connector housing is structured such that it includes a switch contact formed integral therewith, not only the present connector device including such terminal is allowed to have a circuit switching function integrally incorporated therein but also it can be structured in a simple form.

What is claimed is:

1. A connector device comprising:

a connector housing; and a terminal incorporated into the connector housing, the terminal including, a connecting portion on a leading end side of the terminal, which is connected to a mating terminal of a mating connector device when the mating connector device is connected to the connector housing, and a switch contact formed integral with the terminal on the base end side of the terminal, wherein the connector device is adapted to be mounted on a printed circuit board including an electrode disposed thereon and used together therewith, the connector housing includes an inner housing supporting the terminal, and an outer housing fixed to the printed circuit board and supporting the inner housing, so that the inner housing is movable with respect to the outer housing as a switching movement, the switch contact is shifted to switch contact state with respect to the electrode by the switching movement.

2. The connector device according to claim 1, wherein the terminal includes a spring portion formed integral therewith and interposed between the connecting portion and the switch contact to apply an elastic contact force to the switch contact.

3. The connector device according to claim 1, wherein the inner housing includes a securing pawl portion which is integrally formed therewith and elastically secures the inner housing to the outer housing to allow the switching movement.

* * * * *